US007133604B1

(12) United States Patent
Bergstein

(10) Patent No.: US 7,133,604 B1
(45) Date of Patent: Nov. 7, 2006

(54) INFRARED AIR HEATER WITH MULTIPLE LIGHT SOURCES AND REFLECTIVE ENCLOSURE

(76) Inventor: David M. Bergstein, P.O. Box 1111, Chino Valley, AZ (US) 86353

( * ) Notice: Subject to any disclaimer, the term of this patent is extended or adjusted under 35 U.S.C. 154(b) by 0 days.

(21) Appl. No.: 11/254,494

(22) Filed: Oct. 20, 2005

(51) Int. Cl.
*F24H 3/02* (2006.01)

(52) U.S. Cl. ..... 392/379; 392/407; 219/200

(58) Field of Classification Search ..... 392/379–385, 392/350, 356, 360, 363–369, 375–378, 411–415, 392/422–424, 485, 488, 483; 34/266–271
See application file for complete search history.

(56) References Cited

U.S. PATENT DOCUMENTS

| | | | | | |
|---|---|---|---|---|---|
| 939,106 | A | * | 11/1909 | Soles | 392/426 |
| 1,006,767 | A | * | 10/1911 | Mauger | 392/410 |
| 1,579,513 | A | * | 4/1926 | Cameron | 250/495.1 |
| 2,379,705 | A | * | 7/1945 | Graves | 392/356 |
| 2,527,013 | A | | 10/1950 | Kjelgaard | |
| 2,607,877 | A | * | 8/1952 | Stevens | 392/483 |
| 2,609,477 | A | * | 9/1952 | Borda et al. | 392/383 |
| 2,919,338 | A | * | 12/1959 | Covault et al. | 392/356 |
| 3,215,828 | A | * | 11/1965 | Bonvallet et al. | 362/218 |
| 3,278,722 | A | | 10/1966 | Fannon, Jr. et al. | |
| 3,289,679 | A | * | 12/1966 | Zellerman | 132/208 |
| 3,403,252 | A | | 9/1968 | Nagy | |
| 3,471,681 | A | * | 10/1969 | Miller | 392/379 |
| 3,575,582 | A | * | 4/1971 | Covault | 392/356 |
| 3,621,784 | A | | 11/1971 | Mundie et al. | |
| 3,786,233 | A | | 1/1974 | Bumpus et al. | |
| 3,934,572 | A | | 1/1976 | Teague, Jr. | |
| 4,197,447 | A | * | 4/1980 | Jones | 392/356 |
| 4,233,494 | A | | 11/1980 | Pawlik et al. | |
| 4,307,284 | A | | 12/1981 | Perron | |
| 4,309,594 | A | | 1/1982 | Jones | |
| 4,482,393 | A | | 11/1984 | Nishiyama et al. | |
| 4,649,261 | A | | 3/1987 | Sheets | |
| 4,680,448 | A | * | 7/1987 | Fester | 392/356 |
| 4,682,010 | A | | 7/1987 | Drapeau et al. | |
| 4,797,535 | A | | 1/1989 | Martin | |
| 4,835,367 | A | * | 5/1989 | Hoffman | 392/376 |
| 4,958,061 | A | | 9/1990 | Wakabayashi et al. | |
| 4,981,815 | A | | 1/1991 | Kakoschke | |
| 5,077,461 | A | | 12/1991 | Hasegawa | |
| 5,155,336 | A | | 10/1992 | Gronet et al. | |
| 5,279,973 | A | | 1/1994 | Suizu | |
| 5,299,499 | A | | 4/1994 | Christophe et al. | |
| 5,345,533 | A | * | 9/1994 | Tarrant et al. | 392/356 |
| 5,382,805 | A | | 1/1995 | Fannon et al. | |
| 5,467,423 | A | * | 11/1995 | Jakubowski | 392/379 |
| 5,561,735 | A | | 10/1996 | Camm | |

(Continued)

FOREIGN PATENT DOCUMENTS

| | | | |
|---|---|---|---|
| FR | 536754 | * | 5/1922 |

(Continued)

*Primary Examiner*—Thor S. Campbell
(74) *Attorney, Agent, or Firm*—Frederick H. Gribbell, LLC

(57) ABSTRACT

An air heater is provided for use in buildings or other structures. The air heater uses infrared lamps to generate a temperature rise in a forced air chamber that contains several infrared lamps, in which two ends of the chamber act as an inlet and an outlet, and in which the chamber has a highly reflective interior surface that reflects the light being emitted by the lamps to multiply the thermal effect of the infrared light sources. An alternative embodiment uses a closed chamber, in which the temperature rise causes the unit to act as a detonator.

20 Claims, 8 Drawing Sheets

U.S. PATENT DOCUMENTS

| | | | | |
|---|---|---|---|---|
| 5,907,663 | A | 5/1999 | Lee | |
| 6,018,144 | A * | 1/2000 | Vogt et al. | 219/388 |
| 6,167,193 | A * | 12/2000 | Birdsell et al. | 392/365 |
| 6,327,427 | B1 * | 12/2001 | Burkett | 392/369 |
| 6,381,407 | B1 * | 4/2002 | Choi | 392/376 |
| 6,667,111 | B1 | 12/2003 | Sikka et al. | |
| 6,818,864 | B1 * | 11/2004 | Ptak | 219/390 |
| 6,868,680 | B1 * | 3/2005 | Sakuma et al. | 62/160 |

FOREIGN PATENT DOCUMENTS

| | | |
|---|---|---|
| FR | 2504768 | * 10/1982 |
| JP | 61-199631 | * 9/1986 |
| JP | 62-293029 | * 12/1987 |
| JP | 2001-153460 | * 6/2001 |
| SU | 193628 | * 3/1967 |

* cited by examiner

INFRARED AIR HEATER WITH MULTIPLE LIGHT SOURCES AND REFLECTIVE ENCLOSURE

TECHNICAL FIELD

The present invention relates generally to air heating equipment and is particularly directed to an air heater of the type which uses infrared lamps to generate a temperature rise in a forced air chamber. The invention is specifically disclosed as a chamber with several infrared lamps within the chamber, in which two ends of the chamber act as an inlet and an outlet, and in which the chamber has a highly reflective interior surface that reflects the light being emitted by the lamps to multiply the effect of the infrared light sources. An alternative embodiment uses a closed chamber, in which the temperature rise causes the unit to act as a detonator.

BACKGROUND OF THE INVENTION

Air heaters that use infrared lamps have been around for years, and are typically broken into two different categories: the first category is for space heaters that heat an open air space, and the second category is for "enclosed" heaters that attempt to heat portions of a chamber or specimens within a chamber. Examples of space heaters are U.S. Pat. No. 4,797,535 (by Martin), U.S. Pat. No. 4,197,447 (by Jones), U.S. Pat. No. 3,575,582 (by Covault), and U.S. Pat. No. 3,278,722 (by Fannon).

Examples of enclosed heaters using electric light bulbs (including infrared light sources) are U.S. Pat. No. 6,868,680 (by Sakuma), U.S. Pat. No. 6,667,111 (by Sikka), U.S. Pat. No. 6,327,427 (by Burkett), U.S. Pat. No. 5,907,663 (by Lee), U.S. Pat. No. 5,382,805 (by Fannon), U.S. Pat. No. 5,345,333 (by Tarrant), U.S. Pat. No. 2,607,877 (by Stevens), and U.S. Pat. No. 2,527,013 (by Kjelgaard). Some of these conventional "chamber" heaters are designed to heat objects or specimens that are placed within the heater, however, the walls or other types of interior surfaces of the heater are themselves not designed to be raised in temperature to any significant amount. Others of these conventional chamber heaters are designed to have some of their interior surfaces raised in temperature, but those same interior surfaces are painted black or otherwise made of a black material, so that they act as a "black body" to re-radiate the thermal energy into the surrounding air.

SUMMARY OF THE INVENTION

Accordingly, it is an advantage of the present invention to provide an infrared light heating apparatus that uses multiple infrared light sources that are located within a chamber, which direct light toward a chamber wall (typically in the shape of a cylinder), in which the interior surface of this wall is highly reflective and increases the effect of the intensity of the radiant energy being emitted from the light sources, in which the chamber has an inlet and an outlet to allow air to pass therethrough, and the air will be heated by the radiant energy.

It is another advantage of the present invention to provide a chamber with multiple light sources that are directed toward an outer wall of the chamber which is highly reflective, in which there are multiple light sources that are positioned along an interior centerline rod that is easily removable for maintenance purposes, in which the highly reflective interior surface increases the thermal effect of the radiant energy that raises the temperature of air passing through the chamber.

It is yet another advantage of the present invention to provide an air heating apparatus that includes a chamber with an inlet and an outlet with air passing therethrough, in which the interior surface of the chamber is highly reflective, and in which there are multiple infrared light sources within the chamber that are directing radiant energy toward the highly reflective surfaces which tend to increase the thermal effect of the radiant energy, in heating the passing air.

It is still another advantage of the present invention to provide a detonator apparatus that comprises a chamber with at least one infrared light source within the chamber, in which the interior surfaces of the chamber are highly reflective and tend to increase the thermal effect of the radiant energy produced by the light source(s), in which the chamber walls are raised in temperature at a substantially uniform rate throughout all of the surface areas of the walls, and when reaching a predetermined temperature, will tend to ignite a layer of explosive material that is positioned around the chamber's interior walls, thereby creating a detonator with a very uniform ignition characteristic.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an air-heating apparatus is provided, which comprises: an enclosure having an outer surface and an inner surface, the enclosure having an inlet air opening and an outlet air opening, the inner surface substantially forming a volume through which air passes as an air flow from the inlet air opening to the outlet air opening, the enclosure's inner surface being highly reflective; an elongated member that is positioned substantially within the volume; and a plurality of light sources mounted to the elongated member, the light sources being positioned so that they emit radiant energy substantially toward the inner surface of the enclosure; wherein: (a) the light sources are spaced-apart from one another along the surface of the elongated member; (b) a spacing between the light sources and the inner surface of the enclosure allows much of the radiant energy to be reflected by the inner surface in a direction that does not directly intersect the light sources; and (c) the air flow is heated by the radiant energy as the air passes through the volume.

In accordance with another aspect of the present invention, a method for method for heating moving air is provided, in which the method comprises the following steps: providing a heating chamber that has an inlet air opening and an outlet air opening, the heating chamber having an enclosure member that substantially forms a volume through which air flows from the inlet to the outlet, the enclosure member having an interior surface that is highly reflective; providing an elongated rod structure substantially within the volume; providing at least one light source that is mounted to the elongated rod structure; emitting radiant energy from the at least one light source toward at least a portion of the highly reflective interior surface of the enclosure member; reflecting, at the highly reflective interior surface of the enclosure member, much of the radiant energy in a direction that does not directly intersect the at least one light source; and heating the air flowing through the volume by way of the radiant energy.

In accordance with yet another aspect of the present invention, a detonator apparatus is provided, which comprises: an enclosure that substantially encompasses a volume of gas, the enclosure having an inner surface and an outer surface, at least a major portion of the inner surface being highly reflective, the enclosure being substantially gas-tight; a layer of explosive material that is positioned along at least a portion of the outer surface of the enclosure; an elongated member that is positioned substantially within the volume; at least one light source mounted to the elongated member, the at least one light source being powered by electricity, the at least one light source being positioned so that, when energized, it emits radiant energy that is directed substantially toward the highly reflective portion of the inner surface of the enclosure; wherein: (a) when energized, the at least one light source emits radiant energy, much of which is reflected by the highly reflective portion of the inner surface of the enclosure, which thereby increases an effect of raising a temperature of the gas within the volume; (b) as the temperature of the gas is raised, a temperature of the enclosure is raised; (c) as the temperature of the enclosure is raised, a temperature of the layer of explosive material is raised; and (d) when the layer of explosive material reaches a predetermined ignition temperature, it detonates.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

The present invention comprises an air-heating system that uses mirrored surfaces to "multiply" the effect of thermal energy that is generated by one or more infrared light-sources, or heat-sources. The mirrored surfaces reflect the infrared photons within a chamber or cavity, and essentially act as a photon "multiplier". This increases the effective thermal output power of the infrared heat-sources by a considerable percentage. Additional increases in thermal energy are also created by convection and conduction of the chamber's interior metal structure.

Figure 1:
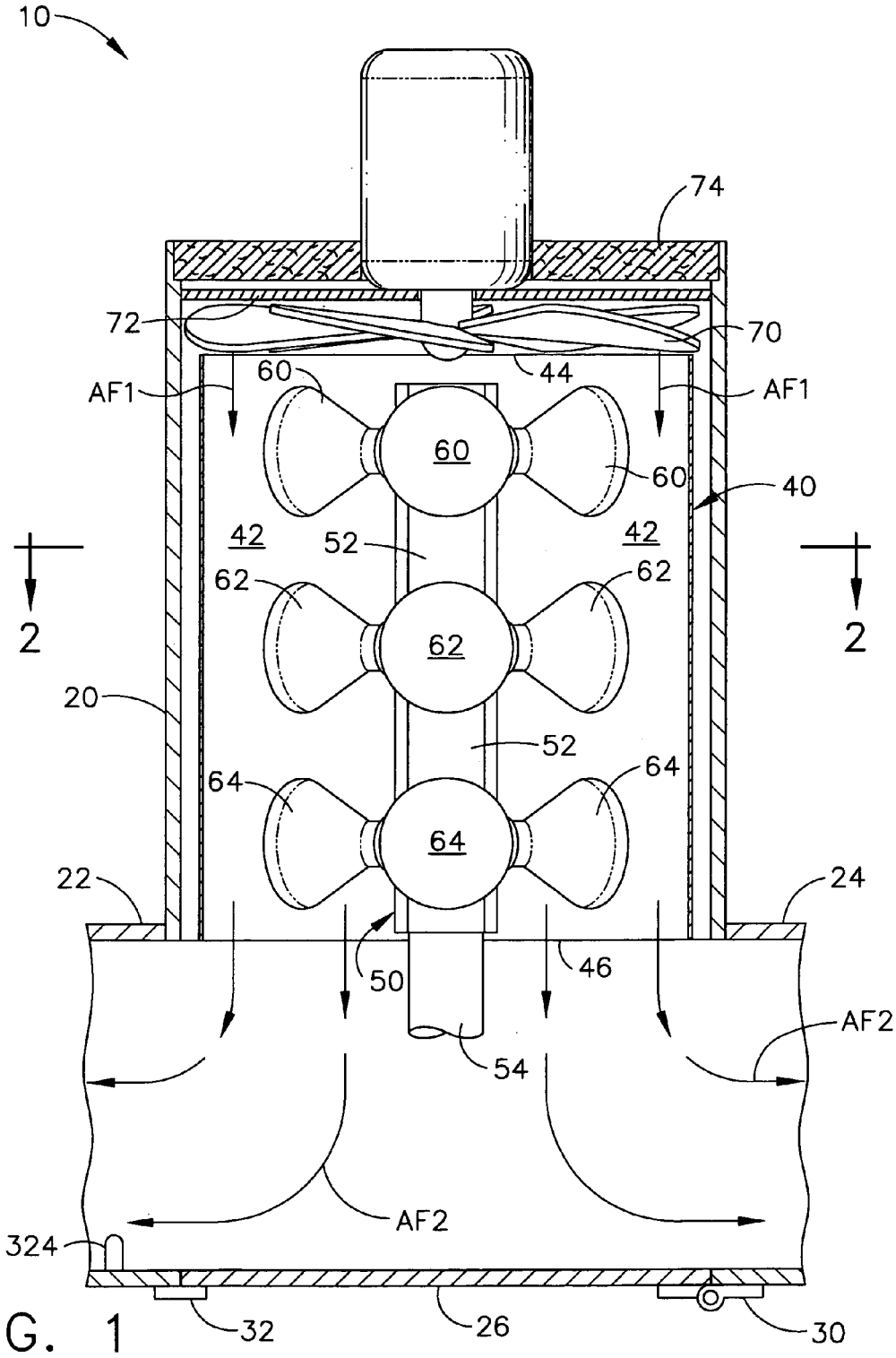
FIG. 1 is a side elevational view in partial cross-section of an air heating apparatus having multiple infrared light sources arranged in a first embodiment, as constructed according to the principles of the present invention.

Referring now to FIG. 1, a cylindrical chamber is illustrated, generally designated by the reference numeral 10. The overall shape of the cylindrical chamber is mainly determined by an outer cylindrical wall or housing 20 that is mechanically connected to a distribution manifold that can allow outlet air flow to be directed either to the left or right (in this view of FIG. 1) by traveling through a first ductwork 22 or a second ductwork 24. In FIG. 1, the bottom-most portion of the ductwork is a pivotable door 26, that has a hinge 30 and a closure mechanism 32.

Within the outer cylindrical wall 20 is another substantially cylindrical structure or enclosure 40 that is somewhat spaced-apart from the outer cylindrical wall 20. This more interior structure 40 has an inner (or interior) surface 42 that is highly reflective, and essentially a mirrored finish is desired. An actual glass mirror could be used, however, it is expected that the increasing temperatures inside the chamber structure 10 will become high enough that glass may not withstand it, and therefore, a different material such as polished steel would probably be more desirable. Enclosure 40 substantially forms a volume, through which air passes from an inlet opening 44 to an outlet opening 46.

Near the center of the chamber 10 is a set of lamps that are mounted on an elongated member 52. The overall subassembly of the lamps and elongated structure is generally designated by the reference numeral 50. An elongated rod 54 extends toward the bottom (in this view of FIG. 1) from the lamps. When in operation, the member 52 is positioned substantially within the volume formed by enclosure 40.

The lamps in FIG. 1 are mounted at three different vertical heights (in this view of FIG. 1), and there are three sets of lamps at 60, 62, and 64. Each set or "bank" of lamps 60, 62, and 64 is comprised of three individual lamp bulbs in this view of FIG. 1. Typically, these are infrared light bulbs, which will emit electromagnetic energy in the form of photons at infrared wavelengths. At these frequencies or wavelengths of electromagnetic (or "radiant") energy, the lamps act as infrared heat sources.

The multiple lamps per bank are mounted at different angular locations along the elongated rod 52, as is easily seen by inspecting FIG. 2, discussed below. Moreover, the individual banks of lamps 60, 62, and 64 can be controlled in various ways, if desired, to vary the power output of the air heating unit 10.

A fan 70 is mounted above the lamp's subassembly 50, which will tend to blow inlet air through a filter 74, and "down" in the direction of the arrows "AF1". The fan 70 is mounted to a cross-brace 72, which itself is mounted to the outer cylindrical wall 20. In one embodiment, illustrated in FIG. 1, the fan 70 is powered by an electric motor mounted to the hub of the fan. As the air is blown along the direction of the arrows AF1, it will pass by the banks of lamps 60, 62, and 64, and through the interior chamber formed by the structure 40, which is designed to increase the overall thermal effect of the electromagnetic radiation being emitted by the lamps. The air will thus be raised in temperature, and will exit along the two ducts 22 and 24, along the arrows "AF2". The air blowing through the duct 22 will pass a location designated by the reference numeral 324. This location could include a temperature sensor to monitor the actual air temperature of the outlet air, for control purposes.

It should be noted that the exact shape of the structures 20 and 40 need not necessarily be cylindrical. A square or rectangular shape would also be useful in the present invention. Moreover, an elliptical shape could be used, if it was desired to maintain at least a curved shape, but had to be placed into a space that was more or less rectangular in profile.

The inside mirrored surfaces 42 could be achieved by use of polished chromium steel. Other materials could be used, including polished aluminum, if desired.

The air temperature can be measured at various places in the structure where a temperature sensor could be positioned, not only at the location 324. Other locations could be within the chamber itself, at the outlet of the chamber (essentially at the location 324 or on the opposite side), or perhaps at the outlet of the manifold, such as further downstream of the ducting, which would be off the page of FIG. 1. Thermocouples or other types of temperature sensors such as RTD's or semiconductor devices could be used.

The door 26 can be opened to re-direct the air, if desired. In any event, it can act as an access entryway, such that the entire lamp subassembly 50 could slide out through the access door along a rack and pinion arrangement (see FIG. 3).

In FIG. 1, the chromium steel structure 40 can comprise a relatively thin sleeve that is inserted into a jacket that supports the entire structure 10. The outer structure or "jacket" 20 could be made of carbon steel, if desired. In addition, a radiation shield could be added to the structure, if desired.

Figure 2:
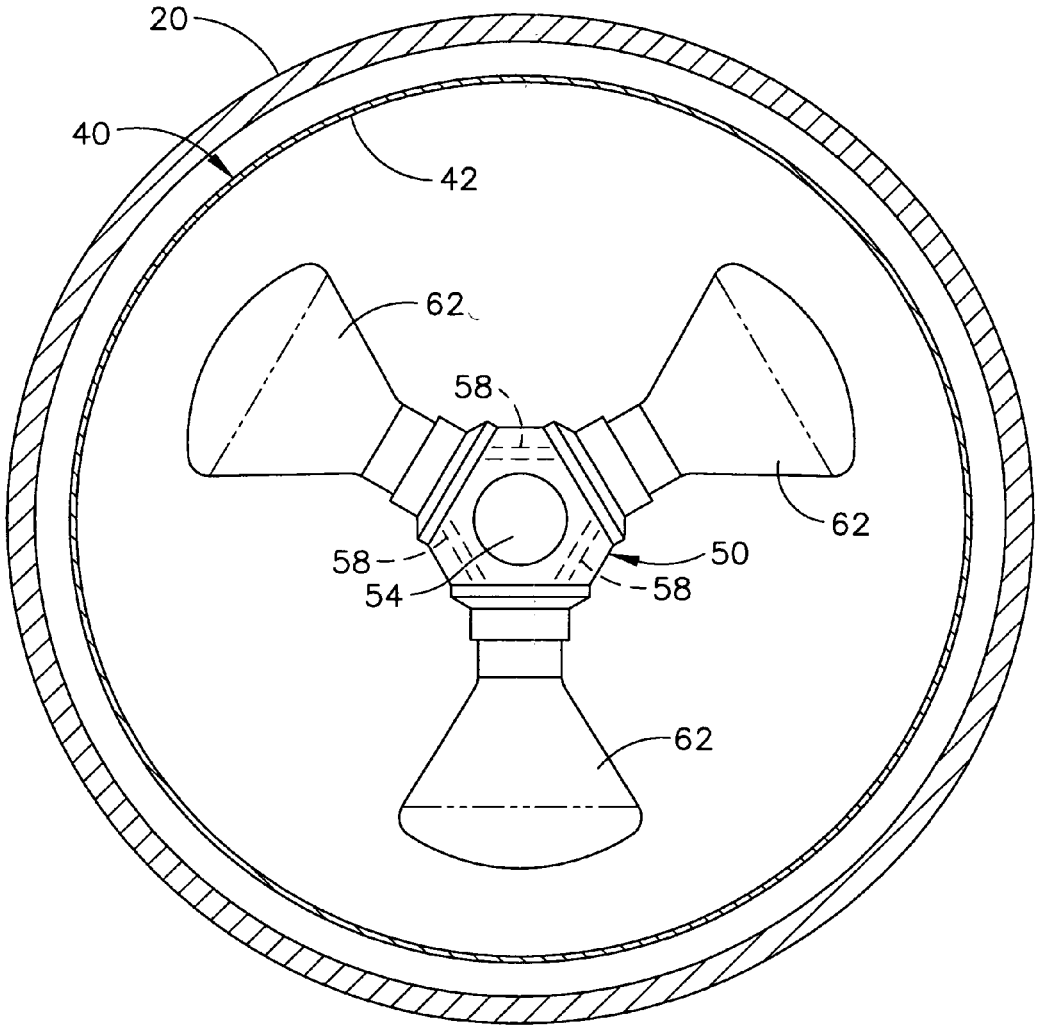
FIG. 2 is a top plan partial cross-sectional view of the air-heating apparatus of FIG. 1, taken along the section lines 2—2.

Referring now to FIG. 2, the structures 20 and 40 are illustrated as being cylindrical in nature, and thus their profile on FIG. 2 is a pair of concentric circles. The structure 20 is the outer ducting or housing, whereas the structure 40 is the reflective structure or enclosure that has the mirrored inner surface 42. The light source module subassembly 50 is depicted as being along the centerline of these concentric circles, and the elongated center rod 54 is easily seen in this view. Rod 54 need not necessarily be a solid structure, and itself can have a cylindrical configuration with an open or hollow area in the central portions. Also, the overall structure of the subassembly 50 is not necessarily a solid piece of material, but more preferably will have hollow passages or conduits at 58 for running electrical wiring, and perhaps other mechanical structures.

The reflective chamber illustrated in FIG. 2 shows the inner surface 42 that can be made of chromium steel that is mirrored or polished. The infrared lamps 62 are arranged at 120° angles in this view, and thus there are three lamps per section or "bank" of the lamp array, along the centerline of the cylinder 20. An electrical control circuit can divide the various lamps into operating banks so that less than "full power" could be used for a lower thermal output. This will be discussed in greater detail below. As can be seen in FIG. 2, the lamps 62 are positioned so that they emit radiant energy substantially toward the inner surface 42 of enclosure 40.

The reflective surface 42 can be made from a flat plate that is later rolled into a tube. Alternatively, the shape of the interior "cylinder" 40 could instead be made in the shape of a square, and thus flat plates could be used throughout, without any rolling operation needed during the construction of the apparatus. It should be noted that the fan 70 would be visible behind the lamps if this view was looking from the "bottom" end of FIG. 1, rather than from above, along the section lines 2—2.

Figure 3:
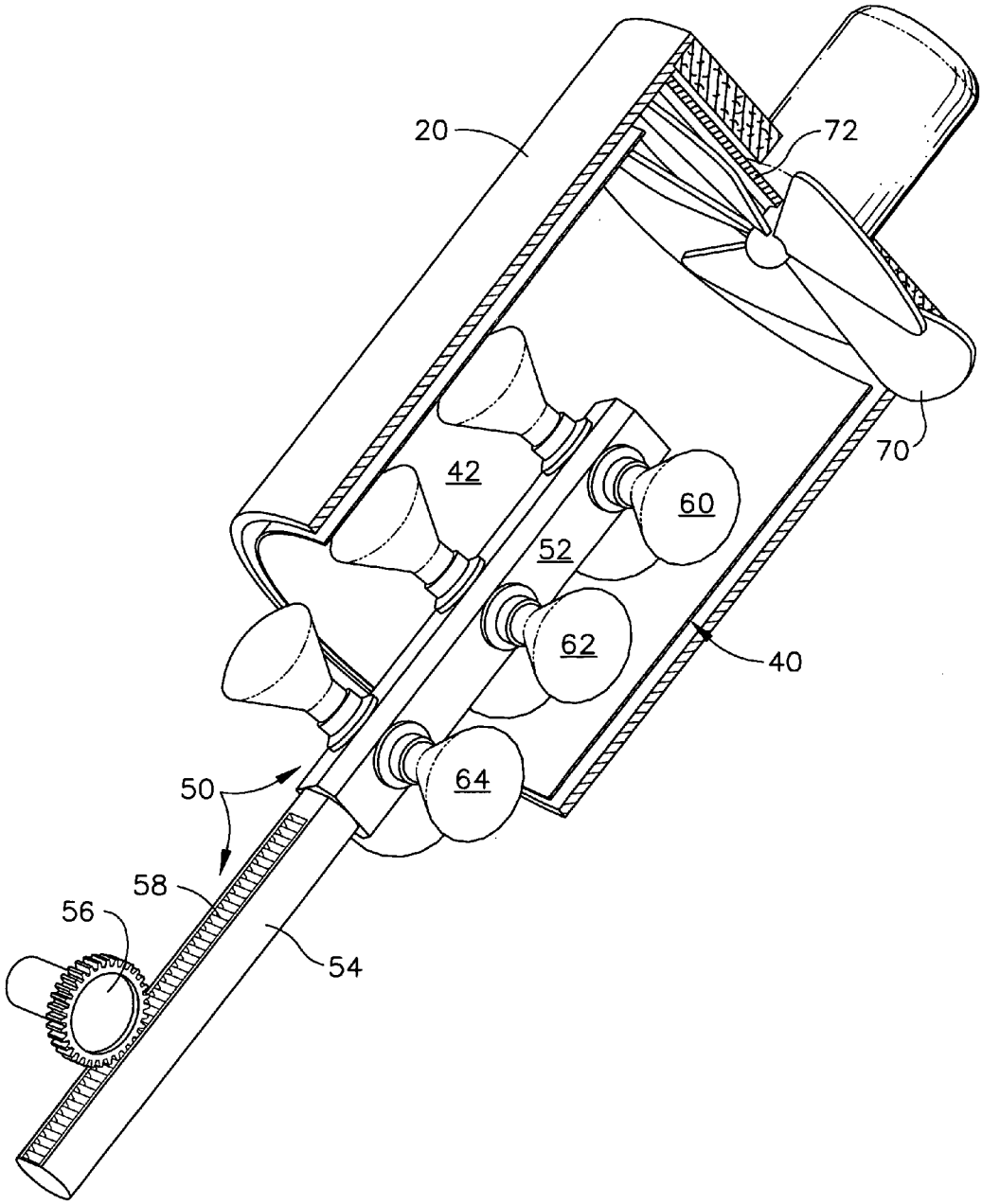
FIG. 3 is a perspective view from the side and below, in partial cross-section, of the air heating apparatus of FIG. 1, with the lamp subassembly partially removed.

FIG. 3 shows the thermal chamber in a perspective view that is partially cross-sectioned. The central portion shows the subassembly 50 that includes the array of infrared lamps in the three banks 60, 62, 64. The lamps are mounted on the central structure 52, which in turn is mounted on a rod 54. The rod 54 works as a rack and pinion, in which the pinion is at 56, and the rack gear teeth are at 58. This allows the entire central subassembly structure 50 to "slide" out for ease of maintenance, so that lamps can easily be inspected and/or replaced, as needed. In FIG. 3, the air intake end is at the "fan" end near the fan 70, and the heated outlet end would be the opposite end. In FIG. 3, the shape of the cavity again is cylindrical, although it could be other shapes, such as a square, hexagon, etc., virtually any type of polygon desired, or rectangular or elliptical, for example.

Figure 9:
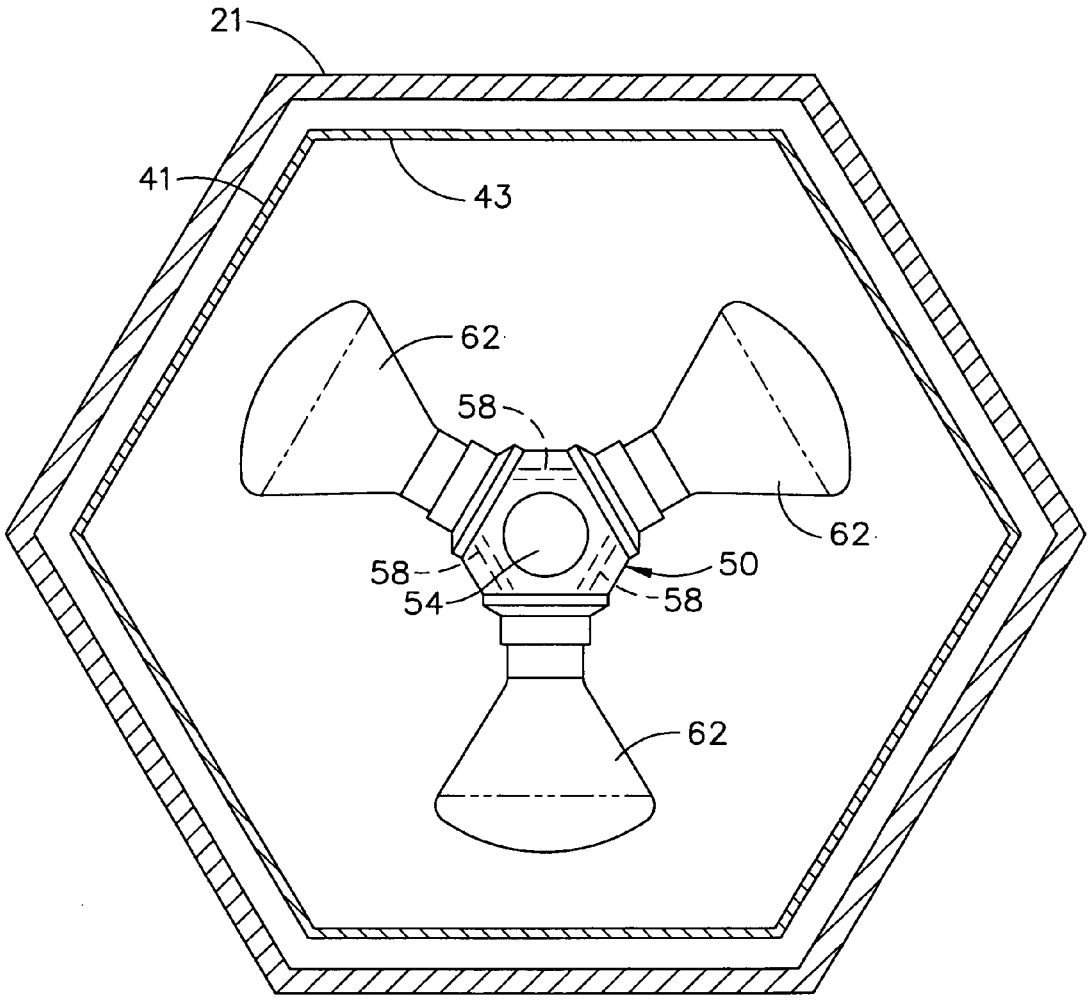
FIG. 9 is a top plan view in partial cross-sectional of an alternative construction of the air-heating apparatus of FIG. 1, in which the outer housing and the mirrored surface of the reflective enclosure are hexagonal, rather than circular.

Referring now to FIG. 9, the structures 21 and 41 are illustrated as being hexagonal in cross-sectional shape, and thus their profile on FIG. 9 is a pair of "concentric" hexagons. The structure 21 is an outer ducting or housing, whereas the structure 41 is the reflective structure or enclosure that has an mirrored inner surface 43.

In general, the mirrored surface will comprise a metal structure, such as steel or aluminum. The mirrored surfaces probably should have a higher melting point than standard mirrors, which have a vacuum applied film of aluminum, rhodium, and/or gold. Such a vacuum applied film can distort when raised in temperature. In addition, it is a better use of the air heater apparatus if the mirror material is thermally conductive, rather than glass, which is thermally insulative. The temperature rise of the mirrored surface will assist in heating the air that is flowing therethrough. This mirrored surface is the opposite of many of the conventional air heating devices.

Figure 4:
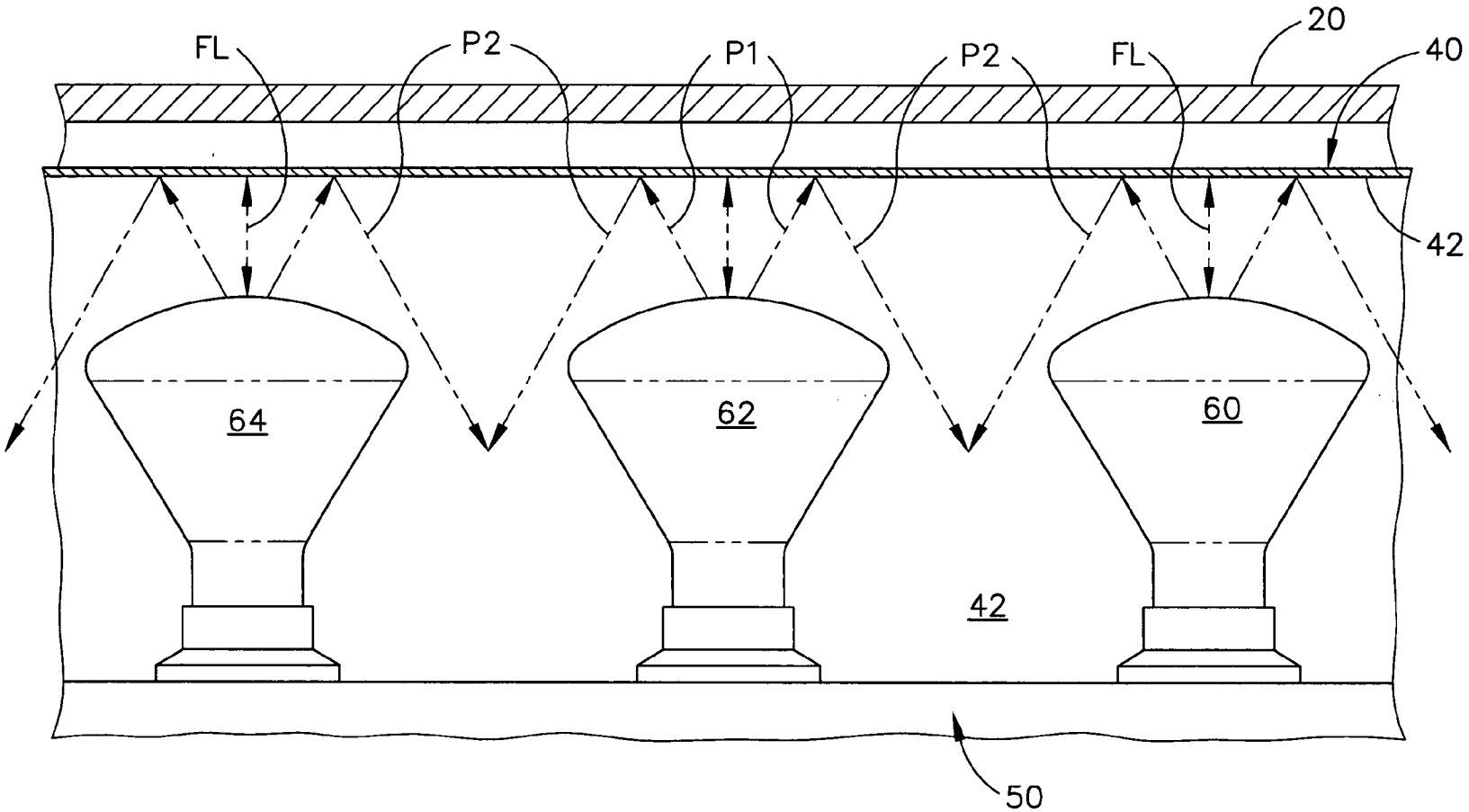
FIG. 4 is a side view in partial cross-section of some of the details of the interior construction of the air heating apparatus of FIG. 1.

Referring now to FIG. 4, the angular relationships of some of the photon pathways are illustrated. The three banks of lamps 60, 62, and 64 are clearly shown as being mounted along the central portion of the subassembly 50. The outer housing structure 20 is depicted, along with the inner chamber structure (enclosure) 40 which has the inner mirrored surface 42. Each of the lamps outputs radiant energy (i.e., electromagnetic energy or photons) at various angles, and some of the angles will be along pathways designed "P1". Such angled photons will reflect off of the mirrored surface 42 and then be re-directed along pathways "P2". As can be seen in FIG. 4, the photons moving along pathways P2 do not directly intersect the lamps themselves, which is generally desirable for this apparatus. The focal length "FL" determines the optimum irradiance, and a proper focal length dimension will tend to keep standing waves away from the centerline of the lamp array and the stems of the lamps themselves.

In general, standing waves are undesirable, since they may overheat the lamp bulbs. Therefore, some distance is needed between the bulb surfaces and the surface of the mirrored reflector 42, thereby to allow the radiant energy to spread out and to not mainly go right back toward the bulbs themselves (i.e., and not directly intersect the bulbs). So long as the focal length FL is sufficiently long, the photons moving along the pathways P2 will miss the lamp bulbs after a single reflection.

In the present invention, it is generally desired for a spacing to exist between the light sources (e.g., lamps 60, 62, 64) and the inner reflective surface 42, so that much (or most) of the radiant energy will be reflected in one or more directions that do not directly intersect the light sources. This spacing is depicted as the focal length FL on FIG. 4. Of course, some photons will travel straight up and bounce straight back (in FIG. 4), so the efficiency of "non-intersections" with the lamps will not likely ever achieve 100%.

The emission angles of the various photons being emitted by the lamps 60, 62, and 64 typically will not be controlled in a standard, commercially available IR lamp. Some lamps may have a focusing lens effect, due to the shape of the bulb, for example. However, in the illustrated embodiment of FIG. 4, it can be seen that it is desirable for much of the light to be emitted at angles other than vertical (in this view), so that the photons do not tend to reflect right back to the bulb. A diffraction grating, or other structure to "bend" or "defect" the light pathways could be placed at the central area of the lamp, if that was felt necessary or desirable by a system designer. However, the present invention has been experimentally tested and works well without such extra optical devices.

If the reflective surface 42 is essentially perpendicular to the "centerline" of the IR lamps (as illustrated in FIG. 4), then the incidence angles of the photons striking the surface 42 will be approximately the same as the emission angles of those photons leaving the lamp. When the reflecting surface is fairly smooth, most of the photons will reflect back (from surface 42) at about the same angle as the (receiving) incidence angle, substantially as illustrated by the photon pathways P1 and P2.

The polarization of the photons does not have to be controlled for the present invention to be effective. In general, a maximum quantity of radiant energy is desired from the IR lamps, so a polarization filter would probably reduce the system's efficiency. On the other hand, if a "directed beam" source, such as a laser diode, were to be used in the present invention, the polarization could be controlled to advantage, although that may be more of a side-effect of the laser diode's characteristic than a direct design criterion.

A specialized IR lamp that tends to emit more to the sides than directly forward could be used to advantage in the present invention, especially if the lamp is "aimed" directly perpendicular to the reflective surface 42, for example. The polarization and emission angles might also be controlled to advantage in such a configuration.

In the figures discussed so far in this patent document, the lamps in one stack of the lamp array are arranged in a generally symmetrical fashion as compared to the other stacks of lamps in this array. This is not necessarily a requirement, and the lamps of one stack do not necessarily need to be symmetrical with all of the other stacks of lamps, although it may be desired.

Figure 5:
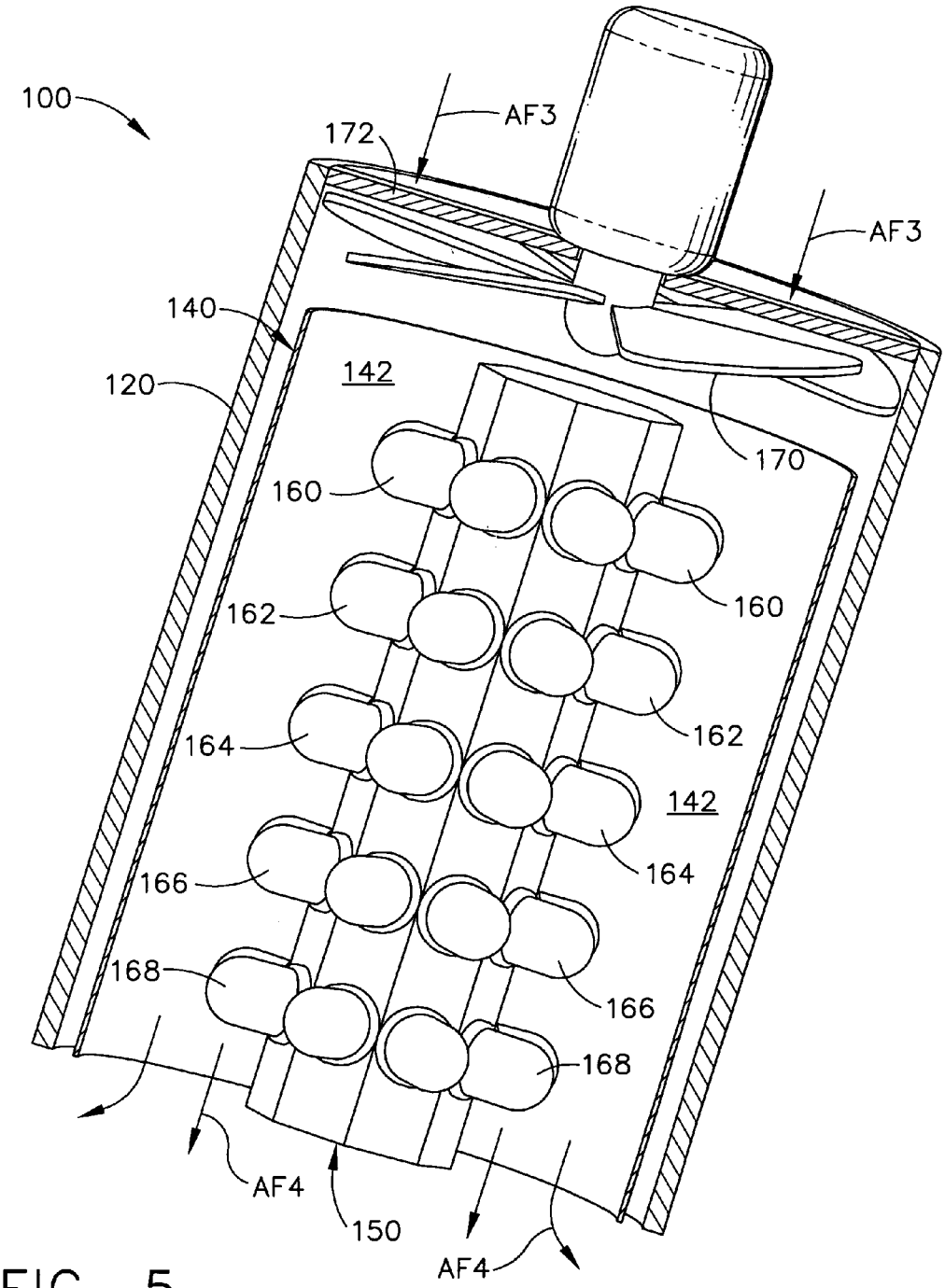
FIG. 5 is a perspective view from the side and above in partial cross-section of a second, alternative embodiment of infrared lamps used in an air heating apparatus, otherwise similar to that of FIG. 1.

Referring now to FIG. 5, an alternative embodiment of the air-heating apparatus is depicted, generally designated by the reference numeral 100. Instead of rather large infrared lamp bulbs, a number of smaller infrared light-emitting diodes could be used, designated at the reference numerals 160, 162, 164, 166, and 168. In a similar fashion to the earlier-described embodiment, these infrared LEDs are arranged in banks, and each bank has a plurality of individual LED light sources. In this illustrated embodiment, all of the LEDs are mounted to a central structure generally designated by the reference numeral 150, which essentially corresponds to the central subassembly 50 depicted in FIG. 1.

The air-heating structure 100 includes an outer wall 120, and an inner structure 140 that has a highly reflective interior surface at 142. The entire structure 150 could also be made to slide out on a rack and pinion, if desired. This overall structure could be made in a smaller package, if desired, since most LEDs will tend to be much smaller than standard infrared light bulbs.

A fan 170 is mounted on a cross-brace 172, which itself is mounted to the outer housing structure 120. The inlet air flow is along the arrows "AF3", while the outlet air flow is directed along the arrows "AF4". Other elements of the alternative embodiment 100 could be essentially identical to that described above in reference to FIGS. 1–4, or it could be used with completely different styles of ductwork and in different locations in a building, for example.

One example of an infrared LED that could be used in the embodiment 100 is a Perkins Elmer part number VTE 1295, which is a near-infrared LED. While these LEDs are smaller than standard infrared light bulbs, they typically are also less efficient. Moreover, some infrared LEDs will output light as a narrow beam, such as a laser diode, for example. Such narrow beam-emitting LEDs may not be desirable when used in the present invention, unless great care is taken to be sure that the narrow beam is not reflected directly back toward the LED emitting source, itself. In general, the banks of LEDs can be controlled in a similar (or the same) fashion as banks of larger infrared light bulbs, if desired. Such control schemes will be discussed below in greater detail.

Figure 6:
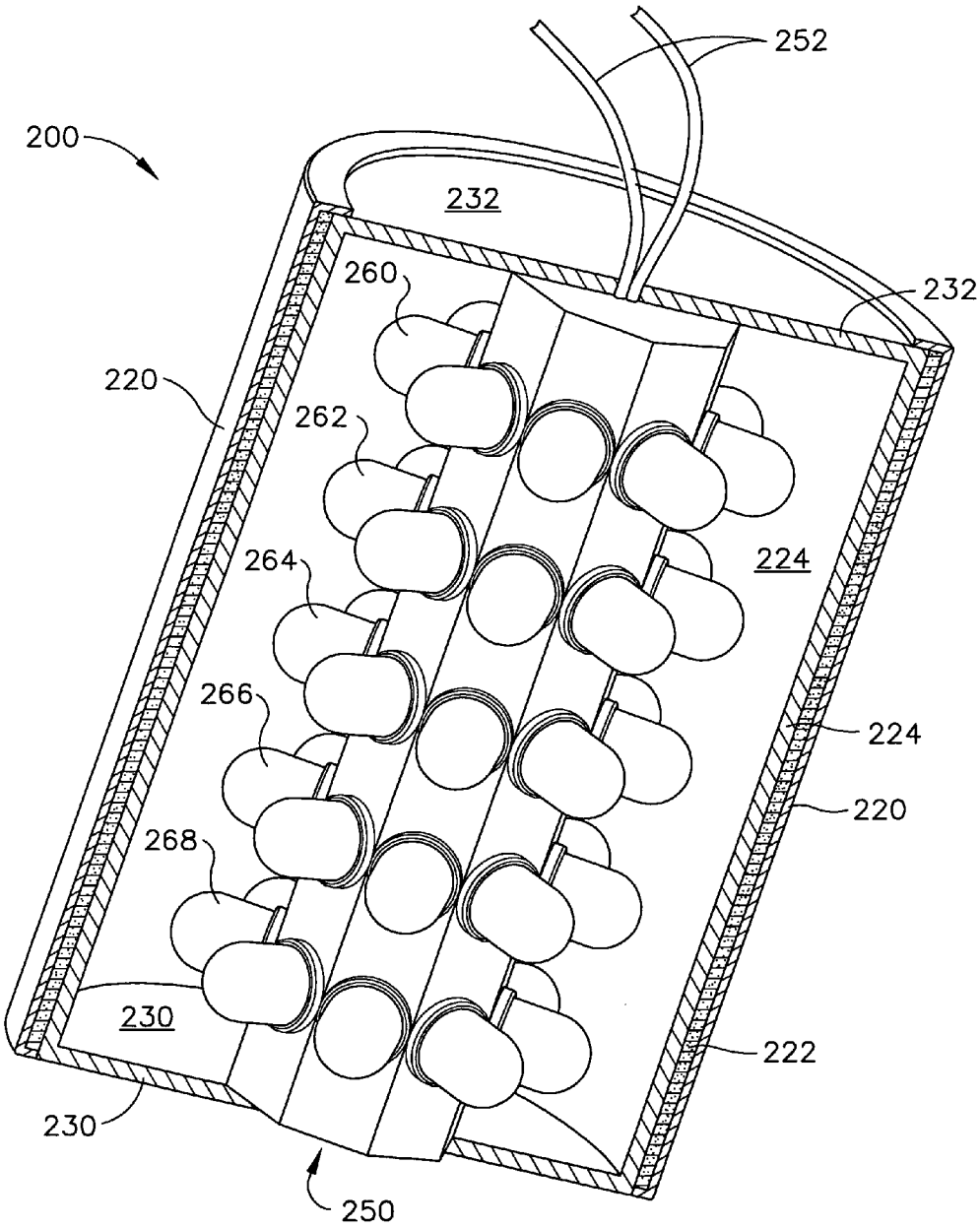
FIG. 6 is a perspective view from the side and above in partial cross-section of a thermal detonator apparatus, as constructed according to the principles of the present invention.

Referring now to FIG. 6, a thermite detonator is illustrated, generally designated by the reference numeral 200. The detonator structure has an outer wall or housing 220 which provides mechanical strength for the structure 200. There is also an interior wall or enclosure 224 that has a highly reflective interior surface. As can be seen in FIG. 6, the outer wall 220 is generally cylindrical in shape, as would be the interior wall 224 when used in this same structure. Sandwiched between these two walls 220 and 224 is a layer of explosive material 222, such as a phosphorous match emulsion. The ignition temperature of the layer 222 would typically be a well-known parameter.

The interior wall 224 also has a lid and bottom which totally enclose the interior cavity spaces of the structure 200. The bottom portion is at 230, while the top portion or "lid" is at 232. The overall enclosure structure typically should be air-tight (or gas-tight if the internal volume is filled with a gaseous compound other than air).

A central lamp-holding elongated member is used to hold several banks of LEDs in this illustrated embodiment. The central subassembly is generally designated by the reference numeral 250, and the LEDs are in banks, at the reference numerals 260, 262, 264, 266, and 268. A pair of wires 252 brings electrical energy to the subassembly 250, for energizing the various LEDs. Typically, all LEDs would be energized together, at full power; also, they typically would be "aimed" at the reflective wall 224.

The outermost layer 220 can be a casing made of aluminum foil, for light weight, if desired. The innermost layer 224 is some type of highly reflective material, such as a mirrored metal. Again, this material could be aluminum, which would be highly polished or otherwise "mirrored". Since the innermost layer is sealed, there is no air flow.

It should be noted that the outermost layer (or housing) 220 is not always necessary. If the explosive material layer 222 is sufficiently sturdy, and if its chemical properties are such that it can be directly contacted by skin, then the system designer may choose to delete it from the structure.

When energized, the entire mirrored cylindrical structure of the enclosure (wall 224) will undergo a very uniform temperature rise, and thus a very uniform detonation of the casing materials will occur once the detonation (or ignition) temperature has been achieved. When the detonation temperature is achieved, the entire casing will likely be heated so uniformly that the entire casing will substantially ignite simultaneously.

The volume formed by the enclosure wall 224, top portion 232, and bottom portion 230 can contain a gas other than air, and this gas could be pressurized to enhance heat transfer, if desired. It could even be pumped out to form a vacuum, if that were desirable for certain explosive applications.

Figure 7:
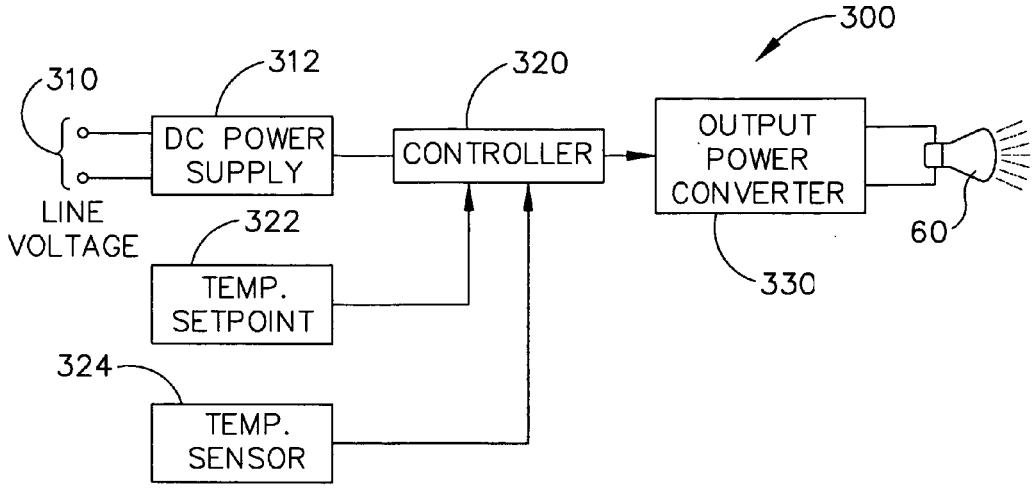
FIG. 7 is a block diagram of some of the major components of a controller apparatus used in the air heating apparatus of the present invention.

Referring now to FIG. 7, the control elements for an electronic control circuit are depicted, in which the circuit is generally designated by the reference numeral 300. In one embodiment of the present invention, it can be powered by line voltage, such as single-phase 120 volts AC, 60 Hz. This line voltage is at 310 on FIG. 7, which provides electrical power to a DC power supply 312. The DC power supply is used to energize a controller circuit at 320.

Controller 320 receives two important inputs, a temperature setpoint at 322 and an actual temperature reading from a temperature sensor 324. (This could be the temperature sensor discussed above in reference to FIG. 1.) The output of the controller 320 will be directed to an output power converter circuit 330. The power converter circuit will take control signals from the controller 320 and increase them to higher voltages and currents required to drive the actual lamps, such as lamp 60 depicted on FIG. 7.

The setpoint device 322 could comprise a standard thermostat, for example, or it could comprise a more sophisticated device. For example, the setpoint device could comprise a digital keypad, or perhaps a small display with up and down keys. Many modern home thermostats are designed with such a display and up/down keys. The type of output of the setpoint device will (obviously) need to be integrated into the controller system, so the controller will interface properly with the input signals that are transferred from the setpoint device. (The input format could be a binary parallel or serial signal, or it could merely be an isolated electromechanical contact, for example.)

If desired, all of the lamps of a single air-heater apparatus 10 could be driven in parallel by the output power converter 330. However, since there are multiple lamps, they can be driven by various methodologies, and each lamp can be driven separately, if desired. This is the essence of the control circuit 350 that is depicted in FIG. 8.

Figure 8:
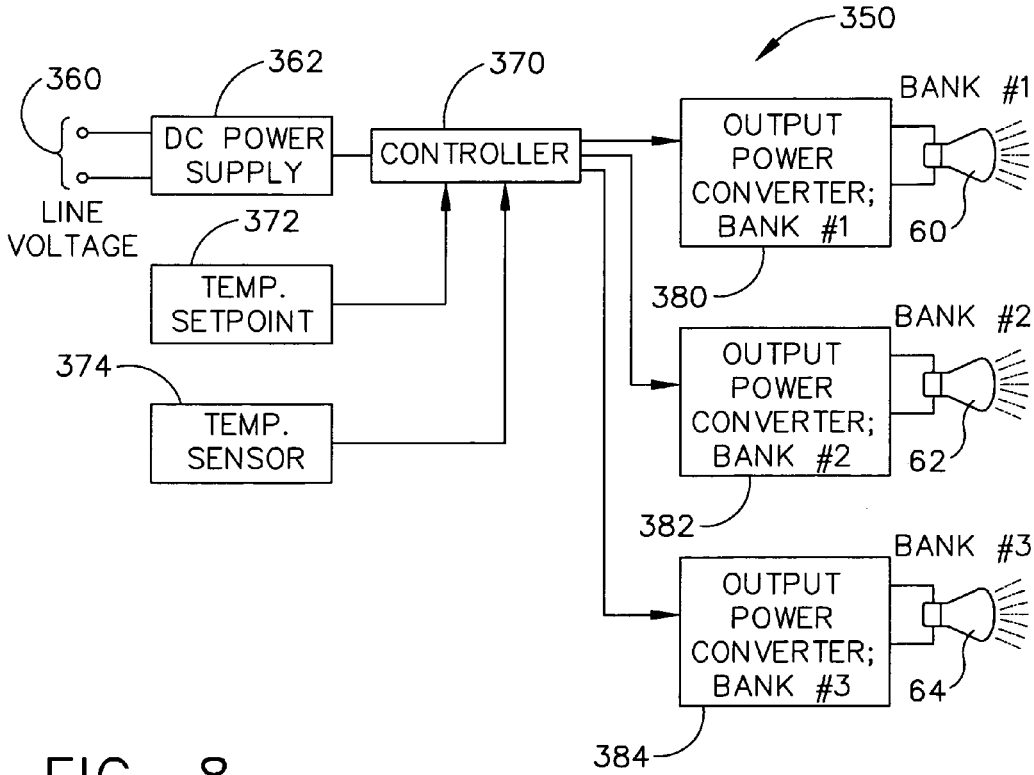
FIG. 8 is a block diagram of some of the major components of an alternative controller apparatus used for the present invention.

In FIG. 8, the line voltage is depicted at 360, which provides electrical power to a DC power supply 362. The DC power supply energizes a controller circuit 370, which receives a temperature setpoint 372 as a control input, and also receives a temperature signal from a temperature sensor 374. It should be noted that the temperature setpoint 372 could be a relatively simple device, such as a thermostat. Alternatively, it could be a more sophisticated device, such as a digital controller that allows a user to manually enter an exact temperature in engineering units (i.e., in degrees F. or degrees C.). This also would apply to the temperature setpoint device 322 of FIG. 7.

In the control circuit 350 of FIG. 8, there are three separate output power converters 380, 382, and 384. Each of these output power converters is used to drive a single bank of lamps. The lamps 60 essentially represent a Bank # 1, whereas the lamps 62 represent a Bank #2, and the lamps 64 represent a Bank #3. Each of these banks can be switched on or off individually, which would allow the air-heating unit to operate at zero percent (0%) thermal output, 33% output, 66% output, or 100% output. The actual thermal output may not be exactly the same percentage as the electrical power that is absorbed in the output power converters and the lamps, but it should be approximately proportional to the input power coming through the line voltage 360.

It should be noted that each of the power converters 380, 382, or 384 can operate as simple ON-OFF devices, or they can operate as a percentage of their waveform. One way of doing this is to perform a wave-chopping function that is controlled by the system controller 370, or using a more sophisticated wave-chopping function that does not necessarily interrupt one of the cycles of a sine wave, but switches only at the zero crossings of the sine wave, to reduce the overall electromagnetic interference that would otherwise be generated by chopping the waveform in the middle of a sine wave half-cycle.

It should be noted that the system controller can be a more sophisticated device if desired, particularly for the air heating embodiment that is used to warm a space, rather than for the detonator embodiment. Many temperature controllers use proportional-integral-derivative (PID) control schemes, and such functions can easily be used with the present invention. A properly programmed PID controller will tend to reduce overshoot and undershoot of the outlet air temperature, for example, by commanding the banks of lamps (or all the lamps if not arranged in banks) when to turn on or turn off. Many heating systems have rather slow-moving output characteristics; the present invention will likely have faster moving temperature rises and falls than many conventional building furnaces or boilers, for example, so the PID controller might need a significantly different set of control parameters for the gain factors, etc.

The invention described herein includes various types of infrared light sources, although other types of thermal sources could be used, if desired. In general, infrared light is most useful for generating heat, and the pathways of the photons can be beneficially controlled by proper reflecting surfaces, as described herein. In the embodiments described above, the lamps are positioned on a centerline elongated rod, and that of course is not the only ways the invention could be constructed, nor does the central elongated rod necessarily have to be mounted on a rack and pinion for easy removal. To save cost, the structure could be permanently mounted, and could be removable by disassembly of screws or bolts, for example.

The exact ducting that would be useful with the present invention could be quite different than that depicted on FIG. 1, without departing from the principles of the present invention. Furthermore, the interior reflective surface of the enclosure or chamber wall does not necessarily have to be made of a metallic substance, although metal structures that are highly polished or otherwise reflective are fairly inexpensive, and will generally stand up to the higher temperatures that will be observed when using the present invention.

If desired, the outer cylindrical housing or support structure 20 in FIG. 1 could be eliminated and the inner cylindrical structure or enclosure 40 could itself be strengthened to act as the sole structure that creates the cavity or volume that will be heated. This is a matter of design choice. The type of fan, and placement of a fan, in the present invention is also a matter of design choice, and a fan could be located at the outlet instead of the inlet, if desired. In addition, a filter is not necessarily required, depending on the conditions of the building or room where the air-heating apparatus is to be located.

One other variation that could be used in the present invention is to power the light sources with a different type of energy. In the description above, the light sources are all powered by electrical energy. However, technology will change over the passage of time, and future light sources could be powered by chemical energy, nuclear energy, acoustic energy, or perhaps even optical energy. For example, a "central" power source could generate optical energy at an appropriate wavelength (e.g., infrared), and this optical energy could be distributed to multiple locations via fiber optic cables (or other optical wave-guiding devices) to locations where the optical energy is radiated toward the reflective surfaces within the heating chamber of the present invention. In this alternative embodiment, the optical energy could indeed be specifically directed so as to mainly not intersect the light sources (e.g., the output lenses of the fiber optic cables), thereby increasing the overall efficiency of the system. Here, the output lenses (or other output optics) at the terminus of each fiber optic cable (or waveguide) would become the "lamp" or "light source" of the present invention.

In conclusion, the air-heating system of the present invention uses mirrored surfaces, to "multiply" the effect of heat that is generated by one or more infrared (IR) light sources. An enclosure structure is provided to substantially form a volume within which the light sources are placed. The inner surfaces of the enclosure are highly reflective, such as a mirrored surface. The mirrored surfaces reflect the IR photons, within a chamber or cavity (a volume) formed by the enclosure structure, to essentially act as a photon multiplier, which increases the effective thermal power output due to the initial IR radiation emitted by the light sources. Additional increases in thermal energy are also effected by convection and conduction if the enclosure is made of a thermally conductive material, such as steel or aluminum. A fan can be provided to move air through the chamber, between an inlet opening and an outlet opening.

An alternative embodiment uses a closed structure to prevent air flow, in which there are no inlet or outlet openings in the enclosure structure. This alternative embodiment can act as a thermal detonator. The IR light sources raise the temperature of the internal volume within the enclosure structure, both by radiation effects and by convection when the thermally-conductive enclosure rises in temperature. An outer casing is placed along the outer surfaces of the enclosure structure. This casing is made of an explosive material that will ignite at a predetermined temperature.

The enclosure structure itself is raised in temperature, by radiation effects, convention, and by its own thermal conduction. Since the enclosure typically is to be constructed of a thermally conductive material (e.g., steel or aluminum), the entire enclosure structure undergoes a very uniform temperature rise, and thus a very uniform detonation of the casing materials will occur. When it detonates, the entire casing will have been heated so uniformly that substantially the entire casing will ignite simultaneously. In this detonator embodiment, the internal volume could contain a gas other than air, if desired; moreover, the gas could be pressurized, which may assist in a fast temperature rise of the detonator system.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. An air-heating apparatus, comprising:

an enclosure having an outer surface and an inner surface, said enclosure having an inlet air opening and an outlet air opening, said inner surface substantially forming a volume through which air passes as an air flow from said inlet air opening to said outlet air opening, said enclosure's inner surface being highly reflective;

an elongated member that is positioned substantially within said volume; and a plurality of light sources mounted to said elongated member, said light sources being positioned so that they emit radiant energy substantially toward said inner surface of the enclosure and extend radially from said elongated member; wherein:

(a) said light sources are spaced-apart from one another along the surface of the elongated member;

(b) a spacing between said light sources and said inner surface of the enclosure allows much of the radiant energy to be reflected by said inner surface in a direction that does not directly intersect the light sources; and (c) the air flow is heated by said radiant energy as the air passes through said volume.

2. The air-heating apparatus as recited in claim 1, wherein said enclosure has a cylindrical form, and said elongated member is positioned substantially along a centerline of said enclosure.

3. The air-heating apparatus as recited in claim 1, wherein said enclosure has a cross-section shape that is substantially polygonal in form.

4. The air-heating apparatus as recited in claim 1, wherein said light sources comprise infrared lamps.

5. The air-heating apparatus as recited in claim 1, wherein said light sources comprise infrared light-emitting diodes.

6. The air-heating apparatus as recited in claim 1, wherein said elongated member has a rack and pinion mounting.

7. The air-heating apparatus as recited in claim 1, further comprising an outer housing that substantially surrounds said enclosure.

8. The air-heating apparatus as recited in claim 7, further comprising a fan that is mounted to said outer housing.

9. The air-heating apparatus as recited in claim 1, further comprising outlet ducting with a movable access door.

10. The air-heating apparatus as recited in claim 1, further comprising a system controller that energizes said plurality of light sources in banks.

11. The air-heating apparatus as recited in claim 1, further comprising a system controller that energizes said plurality of light sources by controlling a duty cycle of an electrical signal waveform.

12. The air-heating apparatus as recited in claim 1, further comprising a system controller that energizes said plurality of light sources using a proportional-integral-derivative control scheme.

13. The air-heating apparatus as recited in claim 1, further comprising a system controller that: (a) receives an input signal from a temperature sensor, and (b) receives an input signal from a temperature setpoint device.

14. A method for heating moving air, said method comprising:

providing a beating chamber that has an inlet air opening and an outlet air opening, said heating chamber having an enclosure member that substantially forms a volume through which air flows from said inlet to said outlet, said enclosure member having an interior surface that is highly reflective;

providing an elongated rod structure substantially within said volume;

providing at least one light source that is mounted to said elongated rod structure;

emitting radiant energy from said at least one light source toward at least a portion of said highly reflective interior surface of the enclosure member, in which said at least one light source extends radially from said elongated rod structure;

reflecting, at said highly reflective interior surface of the enclosure member, much of said radiant energy in a direction that does not directly intersect said at least one light source; and heating said air flowing through said volume by way of said radiant energy.

15. The method as recited in claim 14, wherein said enclosure has a cylindrical form, and said elongated member is positioned substantially along a centerline of said enclosure.

16. The method as recited in claim 14, wherein said light sources comprise one of: (a) infrared lamps, and (b) infrared light-emitting diodes.

17. The method as recited in claim 14, wherein a fan blows air through said volume, from said inlet toward said outlet.

18. The method as recited in claim 14, further comprising the step of: using a system controller to energize said plurality of light sources using at least one of the following control schemes: (a) in banks; (b) by controlling a duty cycle of an electrical signal waveform; and (c) using a proportional-integral-derivative control scheme.

19. The method as recited in claim 18, further comprising the steps of: (a) receiving an input signal from a temperature sensor, and (b) receiving an input signal from a temperature setpoint device.

20. The method as recited in claim 14, wherein said light sources are energized by one of: (a) electrical energy; (b) chemical energy; and (c) optical energy.

* * * * *

UNITED STATES PATENT AND TRADEMARK OFFICE

CERTIFICATE OF CORRECTION

PATENT NO. : 7,133,604 B1
APPLICATION NO. : 11/254494
DATED : November 7, 2006
INVENTOR(S) : David M. Bergstein It is certified that error appears in the above-identified patent and that said Letters Patent is hereby corrected as shown below:

In column 13, claim 14, line 25, delete “beating” and insert -- heating --.

Signed and Sealed this

Ninth Day of January, 2007

JON W. DUDAS
*Director of the United States Patent and Trademark Office*